US007144255B2

(12) United States Patent
Seymour

(10) Patent No.: US 7,144,255 B2
(45) Date of Patent: Dec. 5, 2006

(54) ELECTRONIC TOY AND TEACHING AID SAFETY DEVICES

(75) Inventor: Arthur F. Seymour, Deerfield, IL (US)

(73) Assignee: Elenco Electronics, Inc., Wheeling, IL (US)

( * ) Notice: Subject to any disclaimer, the term of this patent is extended or adjusted under 35 U.S.C. 154(b) by 234 days.

(21) Appl. No.: 10/834,477

(22) Filed: Apr. 29, 2004

(65) Prior Publication Data

US 2005/0243489 A1 Nov. 3, 2005

(51) Int. Cl.
*H01R 29/00* (2006.01)

(52) U.S. Cl. ..... 439/49; 434/118

(58) Field of Classification Search ..... 439/49; 434/118, 224, 301

See application file for complete search history.

(56) References Cited

U.S. PATENT DOCUMENTS 2,874,317 A * 2/1959 Couse ..... 310/71
3,548,261 A * 12/1970 Chambers ..... 361/807
4,650,425 A 3/1987 McGarry
5,339,219 A 8/1994 Urich
5,742,486 A 4/1998 Yangkuai
5,856,636 A 1/1999 Sanso
6,241,527 B1 6/2001 Rast
6,430,017 B1 8/2002 Finlay, Sr. et al.
6,443,796 B1 * 9/2002 Shackelford ..... 446/91
6,452,399 B1 * 9/2002 Werner, Jr. ..... 324/458

FOREIGN PATENT DOCUMENTS

CN 87 2 01045 U 12/1987

* cited by examiner

*Primary Examiner*—Thanh-Tam Le
(74) *Attorney, Agent, or Firm*—Justin Lampel

(57) ABSTRACT

A battery holder containing positive temperature coefficient (PTC) resetable fuse to electronically limit the maximum current that can be drawn from circuits built using reusable electronic component housings. A power supply with similar housing to reusable battery holders, also designed to limit maximum current and perform electrically equivalent to two or more battery holders. A reusable electronic housing with means for attaching any two leaded electronic component for insertion into quick connect assembly system. This housing also contains a positive temperature coefficient (PTC) resetable fuse to electroniclly limit the maximum current that can be sent through the attached two leaded component.

11 Claims, 5 Drawing Sheets

ELECTRONIC TOY AND TEACHING AID SAFETY DEVICES

FIELD OF THE INVENTION

This invention relates generally to devices used with circuits that easily and quickly connect together and specifically to circuits constructed by children or students. It insures that the circuit will be safe and is designed to prevent damage to components or any object or person in close proximity to these components.

BACKGROUND OF THE INVENTION

There are toys and teaching aids that use a mechanical connector to quickly assemble electronic circuits. Sooner or later these components are connected to a power source such as a battery. If the circuit allows too much current to flow, certain devices may become extremely hot and even explode.

Fuses may be connected in series with the power source that will open when excessive current flows. Since most inexpensive fuses must be replaced, this process is inconvenient and allows the child or student the option of using a conductor that eliminates the protection device. Mechanically resetable fuses are expensive and some can be held in the on position to eliminate the protection feature of the fuse.

Another safety problem exists when polarized capacitors are installed backwards in electronic circuits. The capacitors leakage current will increase significantly and the device will rise in temperature and may even explode. Many existing products do not consider the safety of the child or student when allowing for the insertion of capacitors and other "off the shelf" electronic components.

SUMMARY OF THE INVENTION

Quick connect assembly systems currently being sold consist of a box of electronic devices mounted to quick connect bases. Diagrams for hundreds of circuits are included to educate a student or entertain a child. When these circuits are assembled the child can listen to a radio station, send a flying saucer on mission, create and store sounds . . . just to name a few. Sooner or later the child or student will either connect a component incorrectly or decide to experiment with the connections.

Whenever new circuits are constructed the potential for damage to the parts will occur and safety problems will arise.

To take care of excessive current and circuit shorts, a specially designed battery holder and AC/DC interface containing a PTC resetable fuse has been invented. A positive temperature coefficient (PTC) resetable fuse electronically limits the maximum current and automatically resets when the problem is removed. This device can be inside the module and not available to the child or student for maximum amount of protection. When the battery holder provides the input power, the PTC resetable fuse is in series with the positive terminal. Even if the external power supply with quick connect circuit type connector is used, the student or child is protected since it also has the PTC resetable fuse in series with the positive terminal.

This PTC fuse will rise in resistance value and limit the amount of current flowing whenever it is raised in temperature. By placing it in series with electronic components, it will limit both AC and DC currents to a safe level if the parts are used incorrectly. As current increases the temperature of the PTC also increases. This raises the resistance of the PTC which lowers the voltage and prevents damage to the electronic components. As soon as the electrical current level is restored to a safe level, the temperature of the PTC will drop allowing circuits to receive the proper voltage. Placing the PTC inside the battery holder or inside the quick connect circuit AC/DC power plug, prevents the user from touching it when it is at an elevated temperature. The use of non-polarized capacitors will help take care of incorrect DC connection of capacitors but will not cure the problem of extremely high AC currents through capacitors that can also cause heating and explosion. By placing PTC resetable fuses, that cannot be removed by the child or student, in series with sensitive electronic components of all these problems can be eliminated. Adding the PTC resetable fuse in series with any "off the shelf" component will likewise prevent excessive current from flowing. Any module that accepts non-polarized capacitors or "off the shelf" components should have this type of protection.

DETAILED DESCRIPTION OF THE PREFERRED EMBODIMENT

Figure 1:
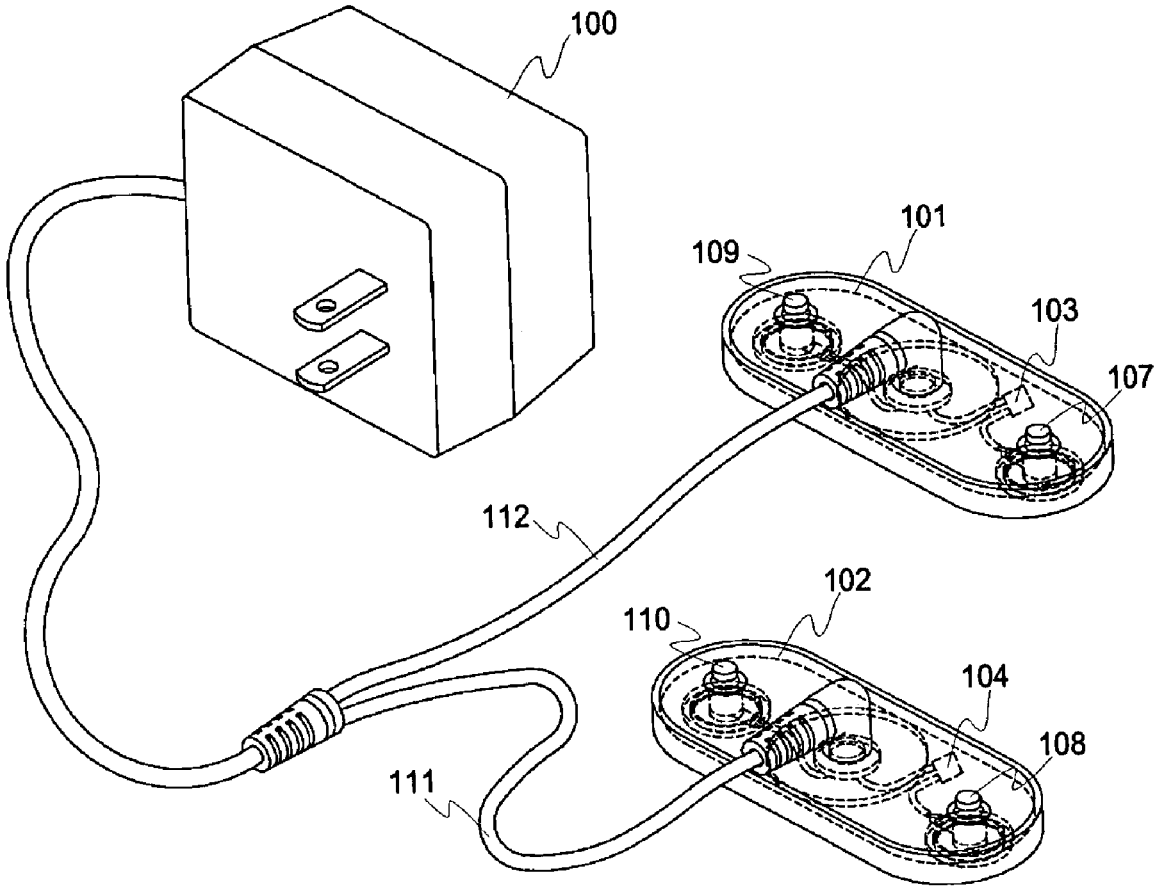
FIG. 1 shows a drawing of a wall type power source 100 that provides stackable DC voltage outputs 107, 108, 109, 110. The special modules 101, 102 on the ends of each output cord 111, 112 are designed to be unique and interface only with snap circuit devices. Each module 101, 102 containing a PTC resetable fuse 103, 104 respectively, wired in series with the plus terminals 107, 108 for safety protection. Each module 101, 102 has a plus 107, 108 and a minus 109, 110 DC voltage output terminal.

The present inventions consist of an improved battery holder module 600, Positive Temperature Coefficient Automatically Resetable Fuses 103, 104, 404 and 605, a specially designed power source 100 with unique stackable output plugs 101 and 102, a quick connect module 400 for electronic components, a clear see through plastic base 500 with mechanical compatible connectors for quick connect circuit interfacing some of which are shown as components 510–516, 600. The battery holder module 600 is designed to be used as a direct replacement for existing quick connect circuit type battery holder modules. The clear plastic base 500 serves as a support to mount the quick connect circuit modules.

The quick connect circuit systems that are presently being sold use battery holders that can be placed in series to stack the voltages. The addition of the Positive Temperature Coefficient Automatically Resetable Fuse 605 prevents shorts from producing heat that can damage the battery holder and cause possible injury to the user. A custom wall adapter power source 100 with multiple outputs 101, 102 must also be stackable to interface properly with the battery powered quick connect circuit designs in use today. Each output plug 101, 102 is driven from an isolated secondary transformer coil 204, 205 and uses a separate regulating circuit 207, 208 respectively. There may be any number of isolated outputs 101, 102 to allow for increased stacking capability. Each one of the regulated circuits 207, 208 contains current limiting features to further insure safety when shorts or bad wiring is present. The unique power connectors 101, 102 are designed to mate only with other snap circuit modules. The actual shape of the connectors 101, and 102 is important because this unique design prevents the battery module 600 from being directly connected in parallel with the AC/DC power source connectors 101, 102. This further increases safety by preventing a child or student from easily plugging a battery module 600 in parallel with a power source connector 101, 102.

Figure 3:
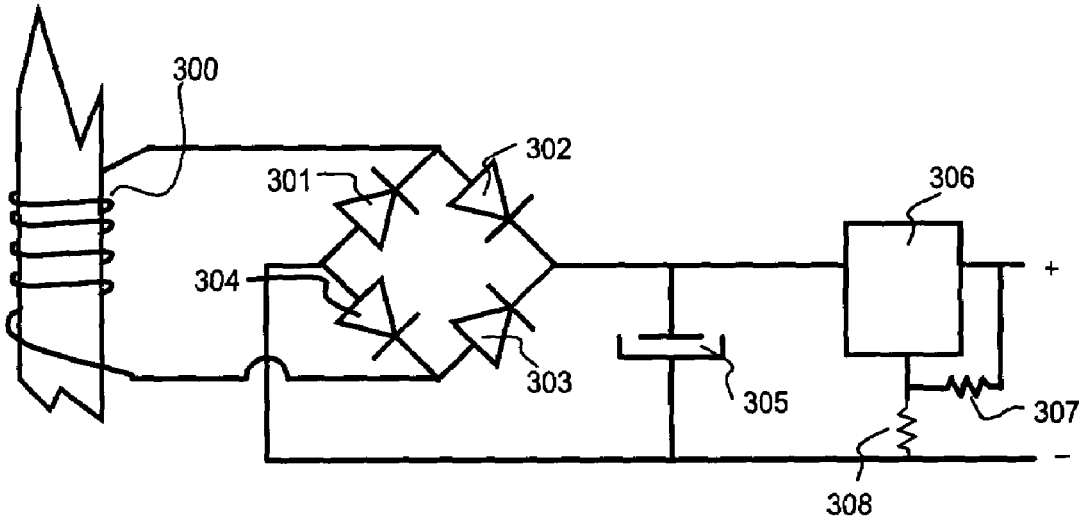
FIG. 3 is a schematic of typical regulating circuit placed in each of the DC output pairs 107, 109 and 108, 110. This circuit provides current limiting and heat protection.

The regulating circuit shown in FIG. 3 is powered by a transformer 200 with a single primary winding 210 and a multiplicity of secondary winding 204, 205. Each secondary winding will need a separate regulating circuit 207, 208 to insure complete isolation. Each regulating circuit 207, 208 will contain an electronic circuit similar to the one shown in FIG. 3.

Figure 2:
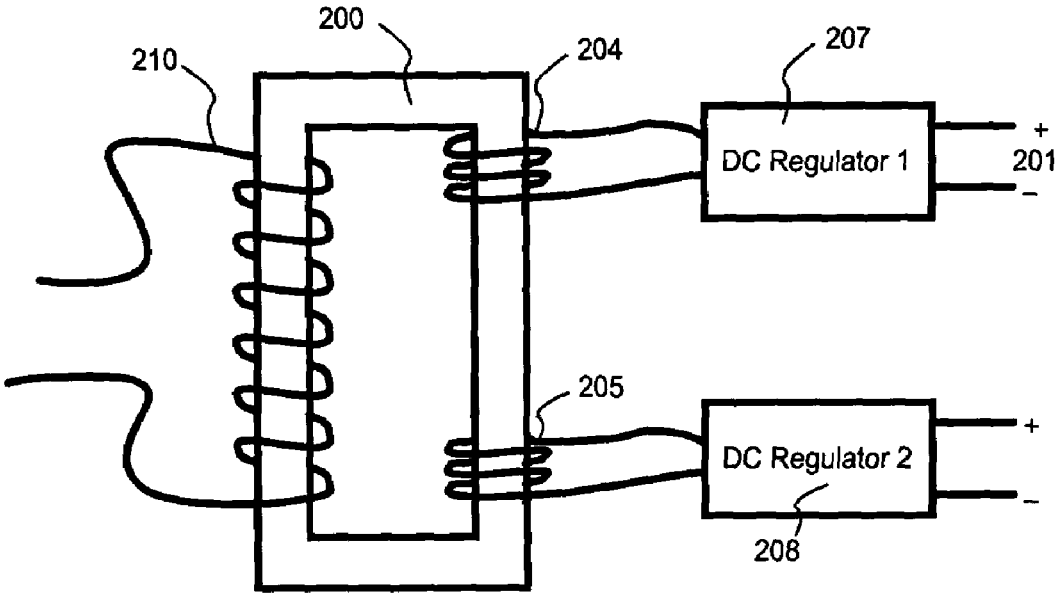
FIG. 2 is a schematic of an electronic circuit used to make the DC outputs 107, 108, 109, 110 of an AC to DC power source stackable (no common ground).

Figure shows the input to the DC Regulator as a secondary winding 300 on a transformer. This could be either of the two secondaries 204, 205 shown in FIG. 2. This secondary drive a diode bridge consisting of diodes 301, 302 303 and 304 and converts the AC input signal to a DC signal. Capacitor 305 is used to filter out AC ripple. The integrated circuit 306, a type similar to the LM317, sets the output at 3 volts, provides regulation, and provides short circuit protection. Resistors 307 and 308 are necessary to set the output voltage at 3 volts.

Figure 4:
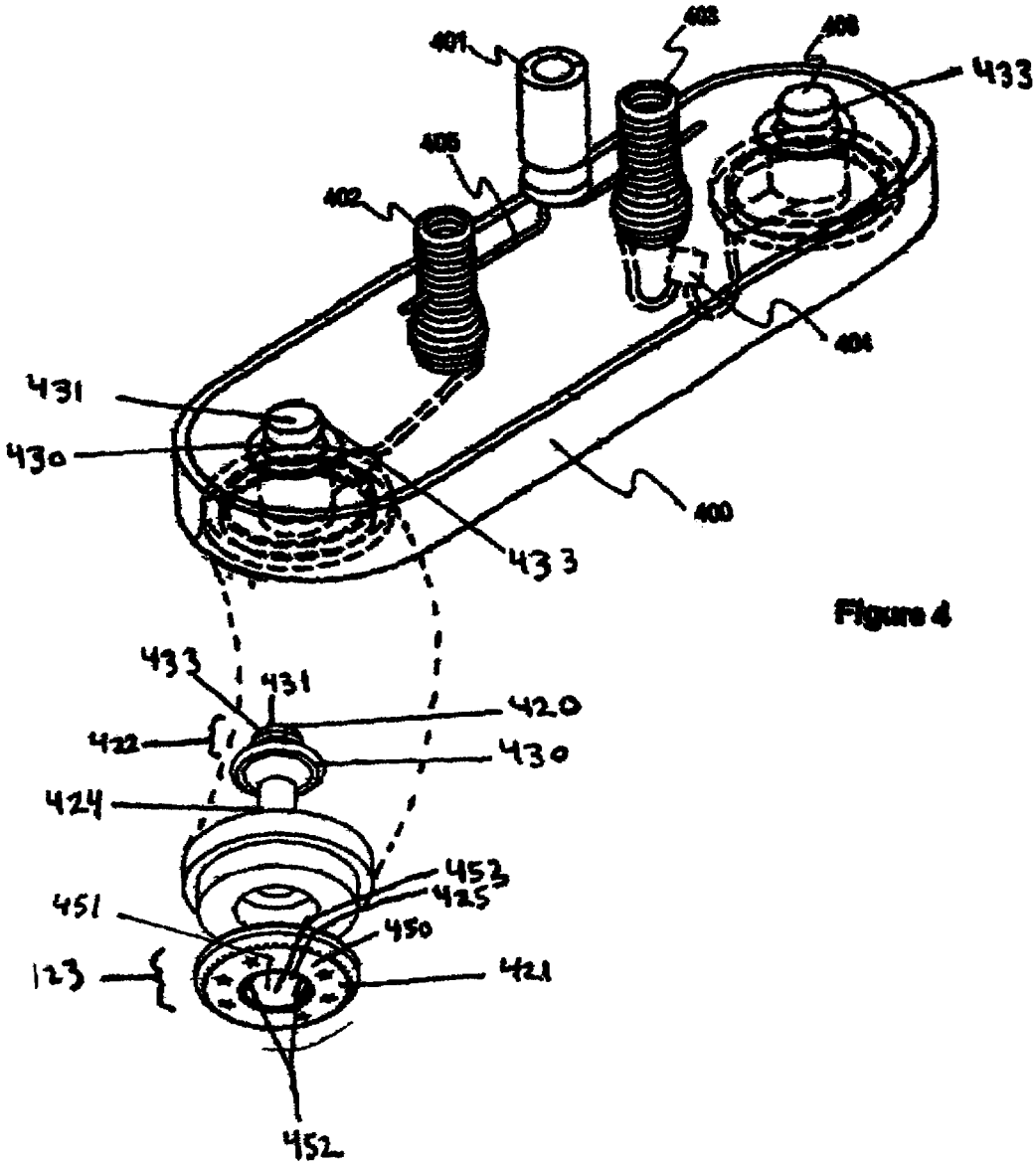
FIG. 4 is a drawing of a quick connect circuit module that uses springs 402, 403 to connect any two leaded "off the shelf" component 401 in series with a PTC resetable fuse 404.

FIG. 4 shows a module 400 that allows a student or child to insert a standard two lead component 401. This module 400 provides a set of clips or springs 402, 403 that easily connect to standard electronic component leads 405. This module 400 also has a Positive Temperature Coefficient Automatically Resetable Fuse 404 in series with one spring connection 403 and the quick connect circuit connection 406 to limit the maximum current that can pass through the connected electronic component 401. The Positive Temperature Coefficient Automatically Resetable Fuse 404 also will limit the current if an AC or DC power source is connected to the springs 402, 403.

Figure 5:
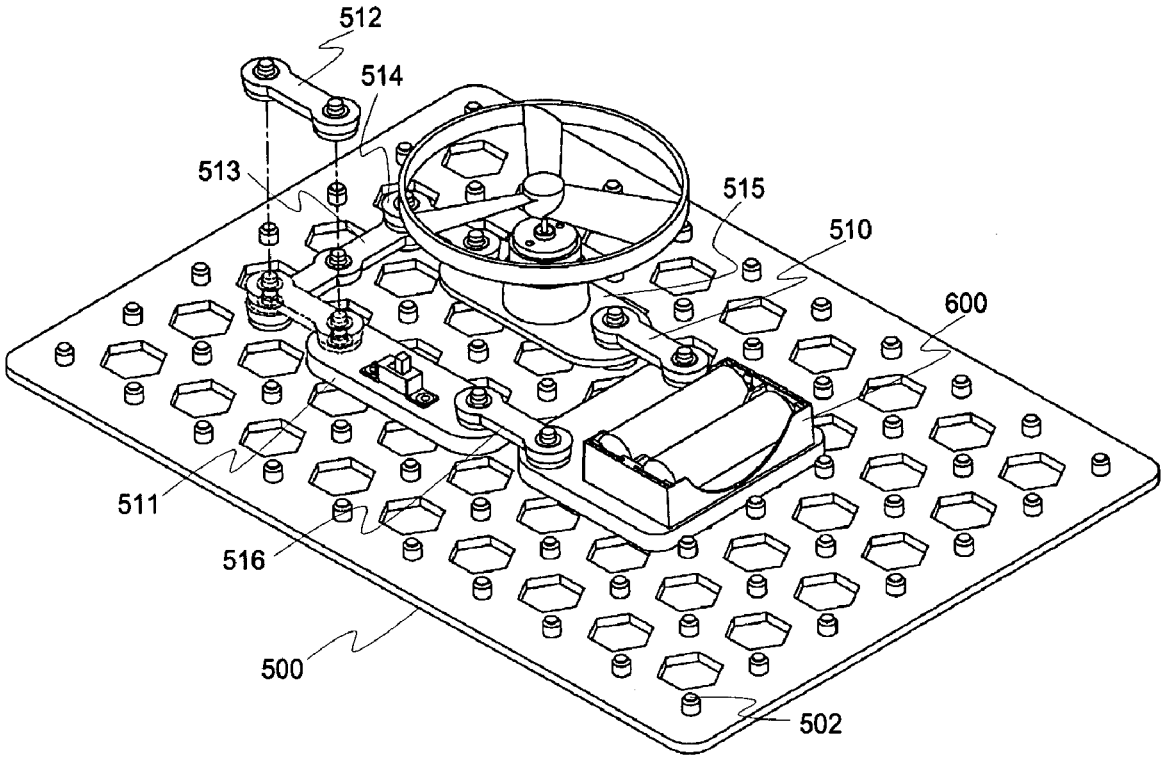
FIG. 5 is a drawing of a clear quick connect circuit Base 500 that can be used to mount battery holder module 600, and other quick connect 510 through 516 similar to the spring circuit module 400.
Figure 6:
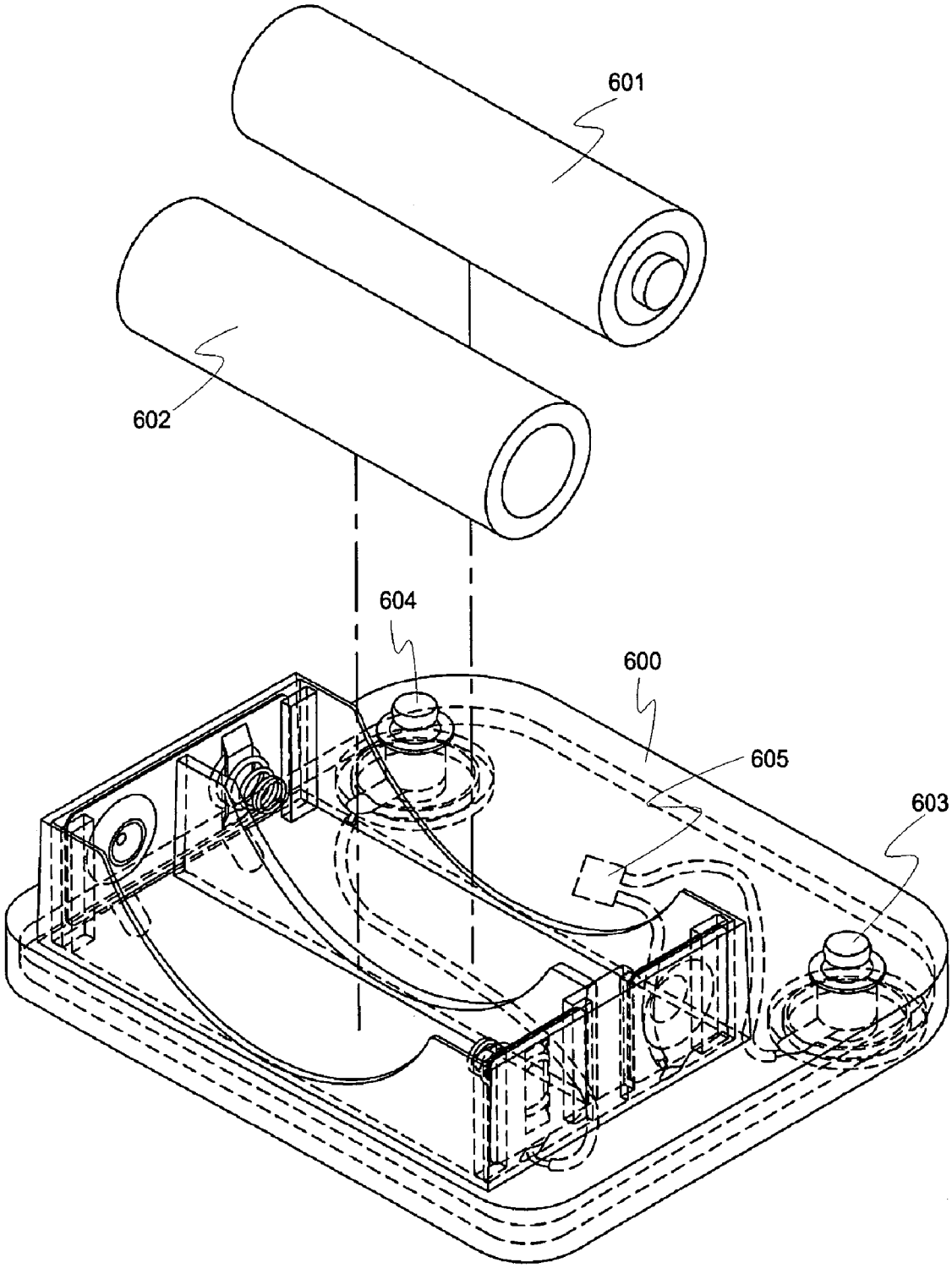
FIG. 6 is a battery holder module 600 designed to hold two batteries 601, 602. The battery has a positive terminal 603, and a negative terminal 604, that are designed to connect to existing snap circuit components. The positive terminal 603 is in series with a PTC resetable fuse 605 to limit the maximum current taken from the batteries 601, 602.

All the modules use a base 500 similar to the one shown in FIG. 5. The plastic post 502 are spaced to accept the circuit connectors that exist on the quick connect circuit modules in use today. A child or student assembles the project by placing the lower layer of modules 600, 511, 513, 515 onto the plastic post 502 of the base 500 first. The second layer of modules 510, 516, 514, 512 are then added to complete the electrical circuit. Since the child or student has the capability of placing modules in any combination, the possibility of short circuits and excessive currents exist if some type of fuse in not in series with all power sources.

The quick connect module 400 of the quick connect circuit connection 406 may have a top side 420 and a bottom side 421. The top side 420 of the quick connect module 400 may have a male member 422 and the bottom side 421 of the quick connect module 400 may have the female member 423. The male member 422 may be connected to the female member 423 via a shaft 424. Accordingly, the male member 422 of quick connect module 400 may not be inserted into the female member 423 of the same quick connect module 400. Instead, the male member 422 of one quick connect module 400 may be inserted into the female member 423 of a different quick connect module 400 or other component. Further, both the male member 422 and the female member 423 may conduct electricity.

The male member 422 may be snap-fittingly coupled with a female member 423. The male member 422 portion of the quick connect module 400 may have a circular plate-like base 430 and a plug 431 integral therewith. The plug 431 of the male member 422 has an outwardly directed semi-circular locking projection 433 engageable with rods 452 of the female member 423 (as is described below).

The female member 423 portion of the quick connect module 400 may have a circular plate-like base 450 and a cylindrical socket 451 disposed on the underside of and integral with the base 450. The base 450 may have a central bore 453 for receiving the male member 422. Located within the central bore 453 may be two rods 452. The rods 452 may be substantially parallel with the bottom side 421 of the quick connect module 400. A cavity 425 may be located above the rods 452 and within the central bore 453. A spring may be located within the female member 423 portion whereby the spring provides pressure which forces the rods 452 toward the center of the central bore 453. While the male member 422 is inserted into the central bore 453 of the female member 423, the outwardly directed semi-circular locking projection 433 of the male member 422 may contact the rods 452 and force the rods 452 away from the center of the central bore 453.

When the outwardly directed semi-circular locking projection 433 portion of the male member 422 has been fully inserted into the female member 423, the outwardly directed semi-circular locking projection 433 may reside within the cavity 425 of the female member 423 and the springs may force the rods 452 inward toward the center of the central bore 453. In this position the male member 422 is removably secured within the female member 423 by the rods 452 which are secured by the springs. The male member 422 may be removed from the female member 423 by applying force to overcome the tension created by the springs in holding the rods 452 under the outwardly directed semi-circular locking projection 433.

Accordingly, although the invention has been described by reference to a preferred embodiment, it is not intended that the novel assembly be limited thereby, but that modifications thereof are intended to be included as falling within the broad scope and spirit of the foregoing disclosure, the following claims and the appended drawings.

What is claimed is:

1. A quick connect circuit electronic system, comprising:

interconnectable electronic components for forming an electronic circuit:

a base comprising a non-conductive base portion and an array of snap-fitting non-conductive male connectors extending upwardly from said base being mounted on the base portion;

a set of modules, each of said modules comprising non-conductive module portion with substantially planar face portions and snap-fitting female electronically conductive connectors connected to said module portion, a plurality of electronically conductive male connectors extending outwardly from and connected to one of said face portions of said module and the snap-fitting female electronically conductive connectors electronically connected to said electronically conductive male connectors on a face portion opposite to one of the face portions of said module, said snap-fitting female electronically conductive connectors being complementary to said male connectors of said base to snap-fittingly receive and matingly engage the male connectors of said base to releasably secure, interlockingly couple and mechanically attach said modules to said base, and said snap-fitting female electronically conductive connectors being complementary to other male connectors of other modules to snap-fittingly receive and matingly engage the other male connectors of said other modules to releasably secure, interlockingly couple, mechanically attach and electronically connect said modules to each other;

said electronic components being mounted on said modules and electronically connected to said electronically conductive male connectors; and at least one of said modules comprising component-receiving connectors securely mounted on said modules for snap-fittingly receiving and releasably engaging at least one of said electronic components to provide a solderless electronic connection thereto.

2. A quick connect circuit electronic system in accordance with claim 1 wherein said electronic components are selected from the group of: capacitors, resistors, diodes, light emitting diodes LED, inductors, transistors, semiconductors, triodes, power supplies, motors, fans, electronic sound emitters, speakers, buzzers, bells, alarms, microphones, light bulbs, strobe lights, switches, integrated circuits, computer chip, amplifiers, modulators, solar panels, computer interfaces, telephone interfaces, and combinations thereof.

3. A quick connect circuit electronic system in accordance with claim 1 wherein said electronically conductive male connectors comprise: metal male connectors selected from the group consisting of snaps, pegs, pins, posts, pedestals, and plugs; and metal female connectors selected from the group consisting of sockets, receptacles, grommets, rings, and tubes.

4. A quick connect circuit electronic system in accordance with claim 1 wherein: said non-conductive base portion comprises a material selected from the group consisting of plastic, wood, paperboard, cardboard, and rubber; and said base portion comprises a foraminous portion with a matrix of openings therein.

5. A quick connect circuit electronic system in accordance with claim 1 wherein said component receiving connectors comprise electronically conductive metal springs selected from the group consisting of: compression springs, spiral springs, and helical springs.

6. A quick connect circuit electronic system in accordance with claim 1 including at least one current limiting device electronically connected to said electronic components on said modules for limiting flow of current through said electronic components to a level below a predetermined maximum threshold to substantially prevent explosion or other damage of said electronic components.

7. A quick connect circuit electronic system in accordance with claim 6 wherein said current limiting device comprises a time delayed current limiter.

8. A quick connect circuit electronic system in accordance with claim 6 wherein said current limiting device comprises a positive temperature coefficient PTC resettable fuse.

9. A quick connect circuit electronic system, comprising:

interconnectable electronic components for forming an electronic circuit:

a base comprising a non-conductive base portion and an array of snap-fitting non-conductive male connectors extending upwardly from said base being mounted on the base portion;

a set of modules, each of said modules comprising non-conductive module portion with substantially planar face portions and snap-fitting female electronically conductive connectors connected to said module portion, a plurality of electronically conductive male connectors extending outwardly from and connected to one of said face portions of said module and the snap-fitting female electronically conductive connectors electronically connected to said electronically conductive male connectors on a face portion opposite to one of the face portions of said module, said snap-fitting female electronically conductive connectors being complementary to said male connectors of said base to snap-fittingly receive and matingly engage the male connectors of said base to releasably secure, interlockingly couple and mechanically attach said modules to said base, and said snap-fitting female electronically conductive connectors being complementary to other male connectors of other modules to snap-fittingly receive and matingly engage the other male connectors of said other modules to releasably secure, interlockingly couple, mechanically attach and electronically connect said modules to each other;

said electronic components being mounted on said modules and electronically connected to said electronically conductive male connectors; and at least one of said modules comprises a battery holder with at least one compartment for holding a battery and automatic resettable short circuit protection circuitry operatively connected to said battery.

10. A quick connect circuit electronic system, comprising:

interconnectable electronic components for forming an electronic circuit:

a base comprising a non-conductive base portion and an array of snap-fitting non-conductive male connectors extending upwardly from said base being mounted on the base portion;

a set of modules, each of said modules comprising non-conductive module portion with substantially planar face portions and snap-fitting female electronically conductive connectors connected to said module portion, a plurality of electronically conductive male connectors extending outwardly from and connected to one of said face portions of said module and the snap-fitting female electronically conductive connectors electronically connected to said electronically conductive male connectors on a face portion opposite to one of the face portions of said module, said snap-fitting female electronically conductive connectors being complementary to said male connectors of said base to snap-fittingly receive and matingly engage the male connectors of said base to releasably secure, interlockingly couple and mechanically attach said modules to said base, and said snap-fitting female electronically conductive connectors being complementary to other male connectors of other modules to snap-fittingly receive and matingly engage the other male connectors of said other modules to releasably secure, interlockingly couple, mechanically attach and electronically connect said modules to each other;

said electronic components being mounted on said modules and electronically connected to said electronically conductive male connectors; and at least one of said modules comprising a wall mounted power source plug and a set of stackable DC outlet plugs connected to said wall mounted power source.

11. A quick connect circuit electronic system in accordance with claim 10 wherein each of said stackable DC outlet plugs comprise protection circuitry to substantially minimize overheating and short circuits.

* * * * *